US006811368B1

(12) United States Patent
Blank et al.

(10) Patent No.: US 6,811,368 B1
(45) Date of Patent: Nov. 2, 2004

(54) ROLL-ON / ROLL-OFF SYSTEM AND PROCESS FOR EQUIPMENT TRANSFER BETWEEN SHIPS OR A SHIP AND QUAY

(75) Inventors: Basil Eric Blank, Lansing, NY (US); Alexander Khosro Deyhim, Ithaca, NY (US)

(73) Assignee: Advanced Design Consulting USA, Inc., Lansing, NY (US)

( * ) Notice: Subject to any disclaimer, the term of this patent is extended or adjusted under 35 U.S.C. 154(b) by 28 days.

(21) Appl. No.: 10/262,713

(22) Filed: Oct. 2, 2002

(51) Int. Cl.[7] ..... B65G 67/60

(52) U.S. Cl. ..... 414/137.1; 414/137.9; 414/139.5

(58) Field of Search ..... 414/137.9, 139.5, 414/139.6

(56) References Cited

U.S. PATENT DOCUMENTS

| | | | | | |
|---|---|---|---|---|---|
| 2,963,178 | A | * | 12/1960 | Walker | 414/139.5 |
| 3,228,051 | A | * | 1/1966 | Voase et al. | 14/71.1 |
| 3,715,769 | A | | 2/1973 | Mori et al. | 14/71 |
| 3,735,440 | A | | 5/1973 | Hetmanski | 14/71 |
| 3,846,860 | A | | 11/1974 | Kummerman | 14/71 |
| 3,971,090 | A | | 7/1976 | Vulovic | 14/71.3 |
| 3,994,036 | A | | 11/1976 | Fisher | 14/10 |
| 4,003,473 | A | | 1/1977 | Ryan | 214/14 |
| 4,043,288 | A | | 8/1977 | Vulovic | 114/270 |
| 4,162,551 | A | | 7/1979 | Serrano | 14/69.5 |
| 4,169,296 | A | | 10/1979 | Wipkink et al. | 14/71.1 |
| 4,345,536 | A | * | 8/1982 | Gregg | 114/124 |
| 4,369,538 | A | * | 1/1983 | Smedal | 14/69.5 |
| 4,581,784 | A | | 4/1986 | Rousseau | 14/71.1 |
| 4,590,634 | A | | 5/1986 | Williams | 14/71.1 |
| 4,655,633 | A | * | 4/1987 | Somero et al. | 404/75 |
| 5,253,381 | A | | 10/1993 | Rawdon et al. | 14/71.5 |
| 5,359,746 | A | | 11/1994 | Kane et al. | 14/711 |
| 5,407,152 | A | * | 4/1995 | Pelischek et al. | 244/159 |
| 5,511,922 | A | | 4/1996 | Sekiguchi et al. | 414/139.6 |
| 5,655,244 | A | * | 8/1997 | Minakami et al. | 14/78 |
| 5,950,266 | A | | 9/1999 | Streeter et al. | 14/69.5 |
| 5,970,881 | A | * | 10/1999 | Takahashi et al. | 104/23.2 |
| 6,192,541 | B1 | | 2/2001 | Castelli et al. | 14/69.5 |
| 6,292,968 | B1 | | 9/2001 | McLain | 14/71.1 |
| 6,524,050 | B1 | * | 2/2003 | Arntzen et al. | 414/140.3 |
| 6,612,799 | B1 | * | 9/2003 | Albers et al. | 414/398 |
| 6,668,747 | B2 | * | 12/2003 | Kjerstad | 114/264 |

* cited by examiner

*Primary Examiner*—Douglas Hess
(74) *Attorney, Agent, or Firm*—Anne M. Schneiderman

(57) ABSTRACT

A process for equipment transfer between two moving transfer stations, such as ships, effected by moving a shuttle to a point adjacent to one transfer station, transferring a load onto the shuttle, moving the shuttle to a point adjacent to the other transfer station and transferring the load to the second transfer station. A machine for accomplishing this process having at least two beams disposed between two moveable stations, connections between the beams that provides constant spacing without substantially increasing the structure's torsional stiffness, a transfer shuttle that can transverse the length of the beams thereby allowing equipment transfer without the need for a continuous deck, and a motor and transmission for moving the transfer shuttle.

18 Claims, 7 Drawing Sheets

ROLL-ON / ROLL-OFF SYSTEM AND PROCESS FOR EQUIPMENT TRANSFER BETWEEN SHIPS OR A SHIP AND QUAY

CROSS REFERENCE TO RELATED APPLICATIONS

Not Applicable

STATEMENT REGARDING FEDERALLY SPONSORED RESEARCH OR DEVELOPMENT

Not Applicable

Description of Attached Appendix

Not Applicable

BACKGROUND OF THE INVENTION

This invention relates generally to the field of loading ramps for ships and more specifically to a roll-on/roll-off system and process for equipment transfer between ships or a ship and quay.

Bridges, ramps and trusses have been used for millennia and constitute a mature field of engineering. New designs have evolved as new applications have arisen, larger spans have been required, it has been necessary to carry heavier weight or new materials have become available. New materials and assembly processes have led to changes in design producing larger, stronger and lighter structures. The weight of a bridge or ramp is important because it can be a significant proportion of the total weight that must be supported.

One emerging application is for a ramp spanning two platforms that may be moving about fixed points. Examples are between two ships, between a ship and a quay or between deep-sea oil rig platforms. Such ramps have been used in so-called roll-on/roll-off ships. When deployed these ramps allow a container to be driven directly between a ship and a quay. In military applications very heavy equipment such as tanks may be loaded or unloaded in this way.

As ships become larger there are many instances when they must be offloaded in deep water onto smaller ships in order to transfer their cargo to port. Military equipment may need to be offloaded where no port is available. In these situations the swell can cause substantial motion, especially in the smaller ship, making roll-on/roll-off cargo transfer impossible in all but the most benign conditions. In addition, the weight of existing ramps, which typically are 30 meters or longer, limits the length of the span. Clearly there is a need for a roll-on/roll-off cargo transfer system that can accommodate the conditions that prevail in deep water. It is also clear that such a system should be lighter in weight than ramps currently in use.

A number of designs have been proposed for ramps or bridges allowing vehicles or passengers direct access to a ship or floating platform. Most of these use one or more rigid ramps attached with hinges to accommodate some types of motion between the two ends. Hetmanski ("Ramp engagement device", U.S. Pat. No. 3,735,440-1973) teaches the design of one type of hinge that allows a rigid ramp to pivot and disengage when necessary. Kummerman ("Movable access ramp for vehicles", U.S. Pat. No. 3,846,860-1974), Vulovic ("Loading ramp securing system", U.S. Pat. No. 3,971,090-1976) and Vulovic ("Ship loading ramp", U.S. Pat. No. 4,043,288-1977) use horizontally hinged, rigid ramp sections to accommodate the difference in height between a quay and a ship's cargo deck allowing for changes due to tides or loading. Rolling is also accommodated. In all three of these patents one or both ends of the ramps may slide. While this may allow some slight fore-and-aft, lateral, or skew motions of the ship the range of motion is extremely limited.

Mori et al ("Slidable mobile bridge", U.S. Pat. No. 3,715,769-1973) teaches means to position a ramp vertically and horizontally relative to a ship. The positioning means is then disengaged from the ramp which simply rests on the ship and quay. Again, this allows only a limited range of motion between ship and quayside.

Subsequent inventors added ball-joints to some ramp sections to allow greater freedom of movement. Stress was also reduced in these designs since ball-joints transmit no moments. Serrano ("Footbridge for connection between a fixed installation and an oscillating installation", U.S. Pat. No. 4,162,551-1979) describes a permanent bridge with a rotating platform at one end and a platform supported on a ball-joint at the other. Three hinged, rigid sections are used to connect these platforms. Six degrees-of-freedom are accommodated with this design, however, the two end sections must have an acute angle from horizontal in order to allow lateral movement. This angle makes it impossible for such as structure to be used for vehicles in roll-on, roll-off applications. Wipkink et al adopted a similar approach ("Connecting bridge for personnel to connect two mutually movable marine structures", U.S. Pat. No. 4,169,296-1979). Two sections were used and an additional pivot, with a vertical axis, was provided between the sections. This patent has no teaching regarding the angle of the ramp sections from the horizontal. If these sections are nearly horizontal, as would be desired for traversal by vehicles, lateral movement could not be accommodated.

Lucien ("Ramp apparatus", U.S. Pat. No. 4,581,784-1986) uses a single rigid ramp section with a gimbal at one end and roller at the other to accommodate relative movement. It would be difficult for vehicles to traverse the gimballed end of the ramp where rapid, extreme motions would occur.

In Rawdon et al ("Hinged cargo ramp", U.S. Pat. No. 5,253,381-1993) two ramp sections are horizontally pivoted with an additional pivot, between the ramp sections, that is oriented in the longitudinal direction. Only a limited number of degrees of freedom can be accommodated.

Kane et al specifically address roll-on, roll-off applications ("Ramp junction", U.S. Pat. No. 5,359,746-1994). A rigid ramp is fixed to a quay by a kingpin, allowing certain degrees of freedom, and to a floating platform by sliding feet. The range of motion that may be accommodated is intentionally limited by shackles.

Sekiguchi et al ("Ship weight cargo loading and unloading system", U.S. Pat. No. 5,511,922-1996) deal with the problem of matching the motion at the end of a ramp to a stationary deck. Vehicles are carried on a lift table that can tilt about two axes to match movement of the ramp. Castelli et al also deal with this problem ("Dynamic ramp interface system", U.S. Pat. No. 6,192,541-2001). A platform is disposed between two ramps that can accommodate rotations about two horizontal axes. The end of each ramp is provided with "fingers" that form the transition between each ramp and the platform. Although this is claimed to be useful in high sea states the transition between rigid ramp sections is still made over only a relatively short portion of the ramp's length.

All of the aforementioned structures share a common feature: the ramp is composed of rigid sections and relative motion, where it is allowed, is concentrated at specific points. This is undesirable for roll-on, roll-off applications where the range of motion may be large, such as in high sea-states. Stresses, especially dynamic stresses, are extremely high at the points where the ramp is attached.

Streeter et al ("Method and apparatus for connecting a passenger boarding bridge to a movable body", U.S. Pat. No. 5,950,266-1999) address the problem of positioning a ramp in a passenger boarding bridge such as is widely used in air and ferry terminals. They provide a system of sensors that control the movement of the passenger bridge in order to maintain a constant attitude of a bridging ramp. While this can accommodate small amplitude motions the size and mass of the passenger bridge make it impossible to reach large amplitudes and velocities.

Three patents teach the use of a flexible ramp for connecting movable platforms. Fisher ("Flexible staging platform and the like", U.S. Pat. No. 3,994,036-1976), Ryan ("Combined marine ramp transfer and mooring system", U.S. Pat. No. 4,003,473-1977) and McLain ("Articulated bridge", U.S. Pat. No. 6,292,968-2001) teach the use of ramps or bridges that can flex to accommodate displacements at the ends as well as rotations about the vertical axes. Stresses at the mounting points are greatly reduced by this flexure. All of these structures are, however, designed for light loads or short spans. The extra strength that would be required for roll-on, roll-off applications would necessitate stiffening of these structures, reducing their ability to deform and transmitting very high forces to the points of attachment.

An ideal ramp structure would combine the ability of these flexible ramps to twist about the longitudinal axis with the hinged pivots taught by many other inventors. Such a structure must have a high load-carrying capacity, despite its ability to twist. In addition, it is desirable that the weight of such a ramp structure is reduced as this weight can be a considerable proportion of its load-carrying capacity.

BRIEF SUMMARY OF THE INVENTION

The primary object of the invention is to allow equipment transfer in rough seas with a maximum average wave height of at least 15 feet.

Another object of the invention is to allow the loading and unloading stations to move about a point with six degrees of freedom during transfer.

A further object of the invention is to reduce the forces transmitted from the movement of one station to the other.

Yet another object of the invention is to accommodate a larger range of motion than current roll-on/roll-off ramp designs.

Still yet another object of the invention is to decrease the torsional stiffness of the transfer system below that of current roll-on/roll-off designs.

Another object of the invention is to reduce the stresses at the attachment points of the transfer system.

Another object of the invention is to carry heavier weights than existing roll-on/roll-off ramps.

A further object of the invention is to weigh less than existing roll-on/roll-off ramps.

Yet another object of the invention is to decrease the cost of roll-off/roll-on systems.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine comprising: at least two beams disposed between two moveable stations, each of said beams being fixed with respect to the first of said stations such that there is no horizontal or vertical displacement or rotation about said beams' respective longitudinal axes; a support means for each of said at least two beams at the second of said moveable stations, said support means allowing displacement along, and rotations normal to, said beams' respective longitudinal axes; connecting means between said at least two beams that provides constant spacing without substantially increasing torsional stiffness; a transfer shuttle that can traverse the length of said at least two beams thereby allowing roll-on/roll-off equipment transfer without the need for a continuous deck and a means for imparting motion to said transfer shuttle.

In accordance with a preferred embodiment of the invention, there is disclosed a process for equipment transfer between two moveable stations comprising: moving a shuttle to a point adjacent to one of said transfer stations; transferring a load onto said shuttle; moving said shuttle to a point adjacent to the second of said transfer stations; transferring said load from said shuttle to said second transfer station and returning said shuttle to said first transfer station.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. Like numbers are used to represent like parts of the invention throughout the drawings.

Figure 5:
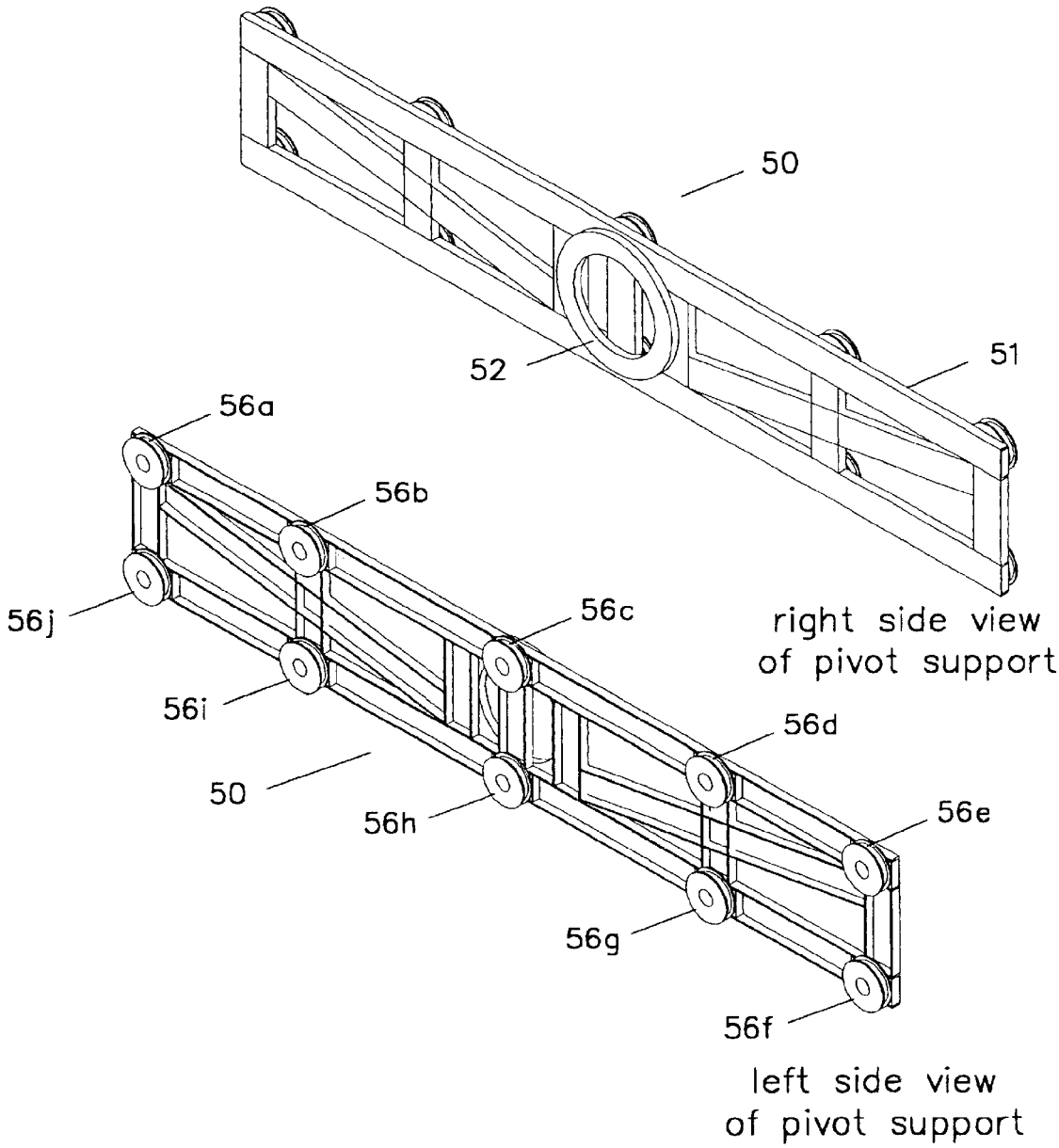

Details of the pivot assembly are shown in the isometric view of FIG. 5.

Figure 6:
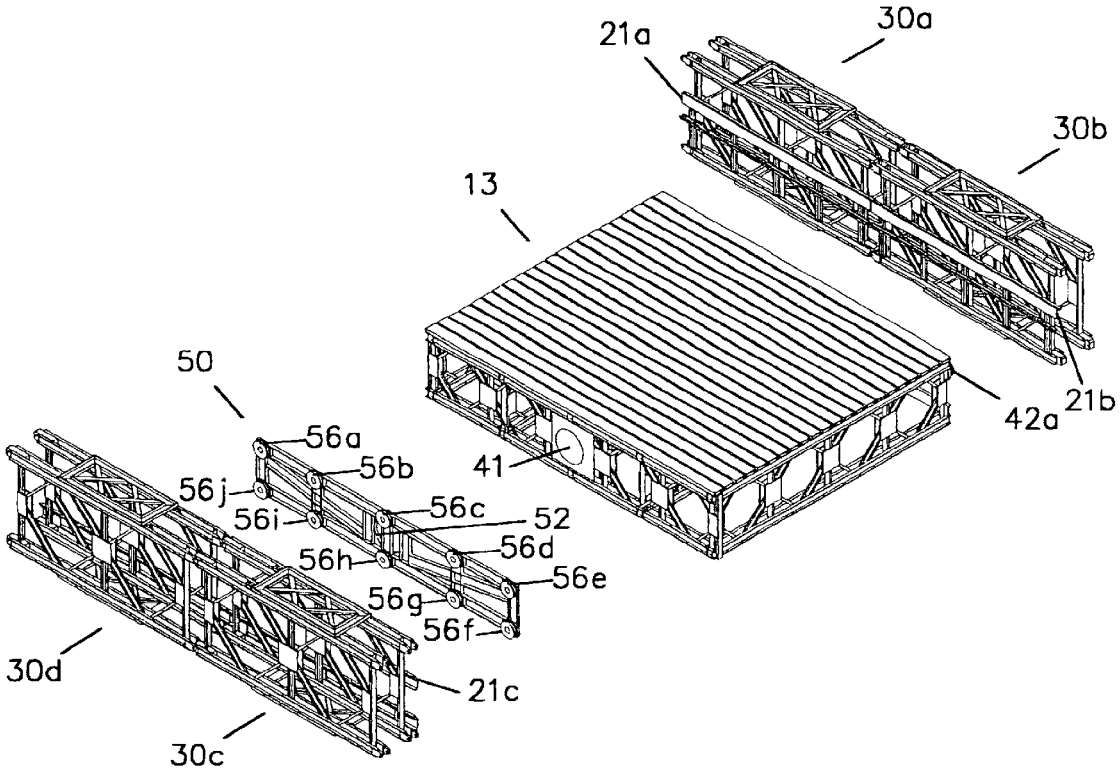

An exploded view of the transfer shuttle, its supports and several modular beam sections is given in FIG. 6.

Figure 7:
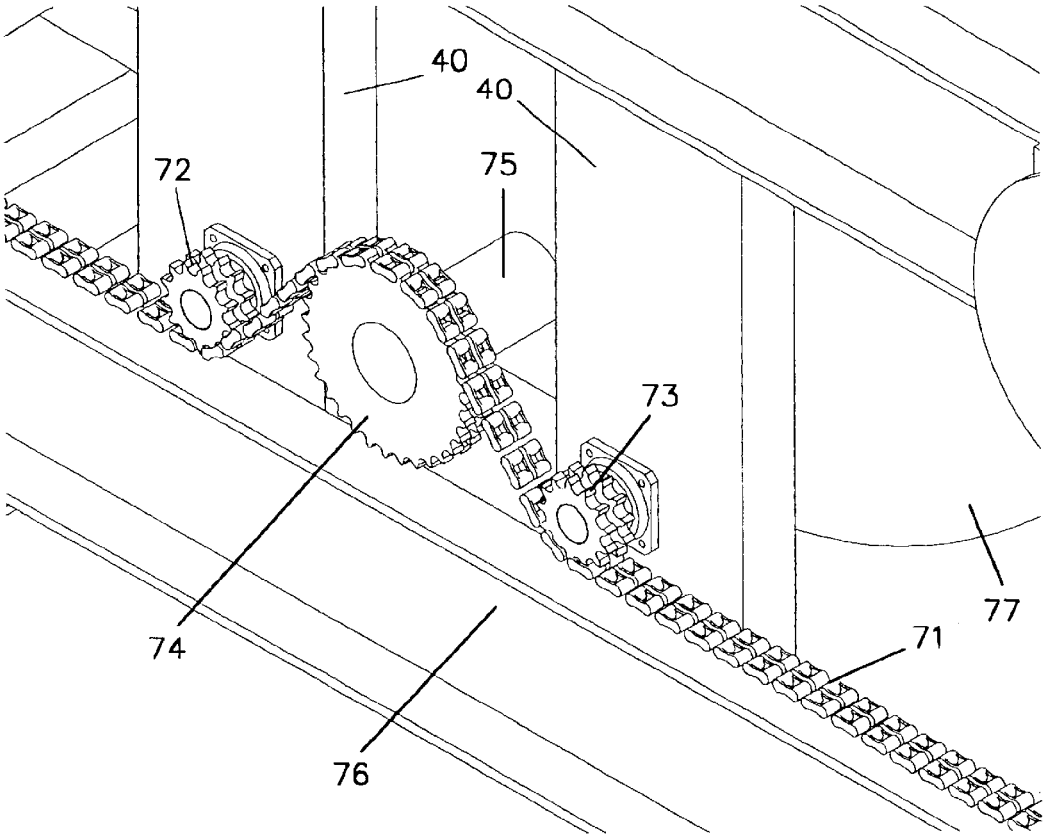

FIG. 7 is an isometric view showing the drive mechanism that is carried within the transfer shuttle.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
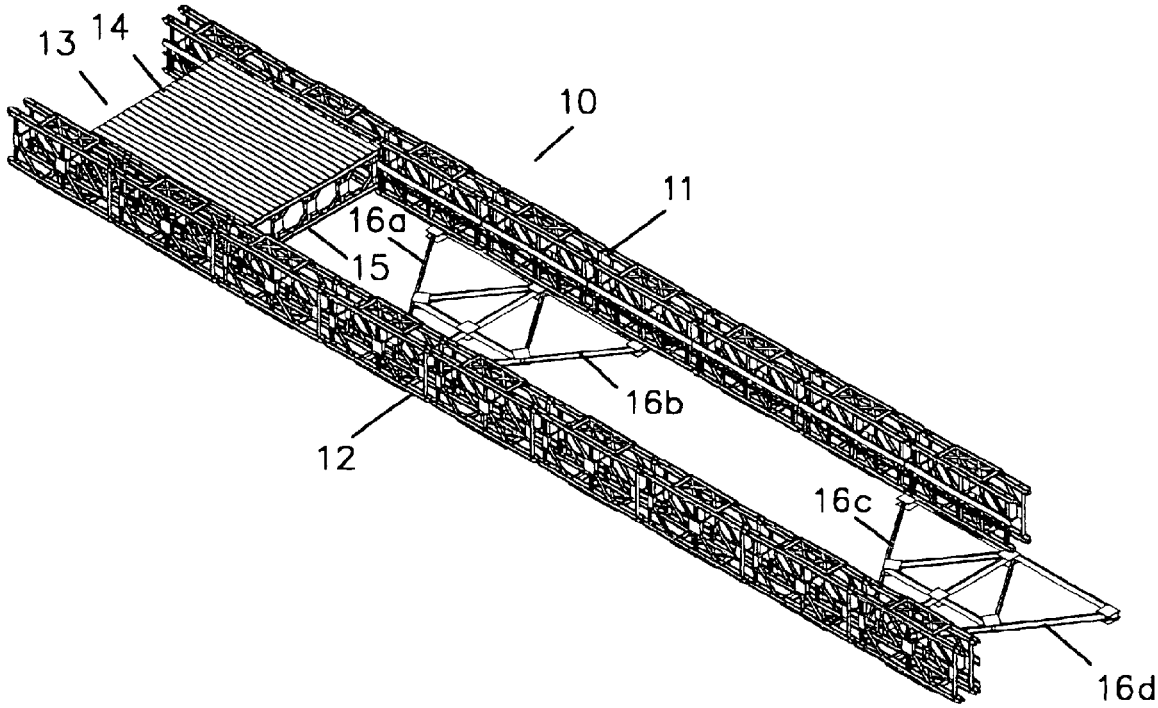
FIG. 1 is an isometric view of the roll-on/roll-off transfer system showing the major components.

The major components of the roll-on/roll-off transfer system 10 (hereinafter referred to as the RORO system) are shown in FIG. 1. Two beams 11 and 12 support a shuttle assembly 13 that transports vehicles from a transfer station to a receiving station. Said shuttle assembly comprises a deck 14, a supporting frame 15, means to rollably support said frame (not visible) and motion means (not visible). Beams 11 and 12 are typically 30 to 40 meters in length. Either or both ends of the RORO system 10 can be mounted on a vessel that moves with six degrees of freedom.

The spacing between beams 11 and 12 is maintained by lateral connectors 16*a*–16*d*. The connections between said connectors and said beams may be pinned to allow independent motion while maintaining a constant spacing.

Figure 2:
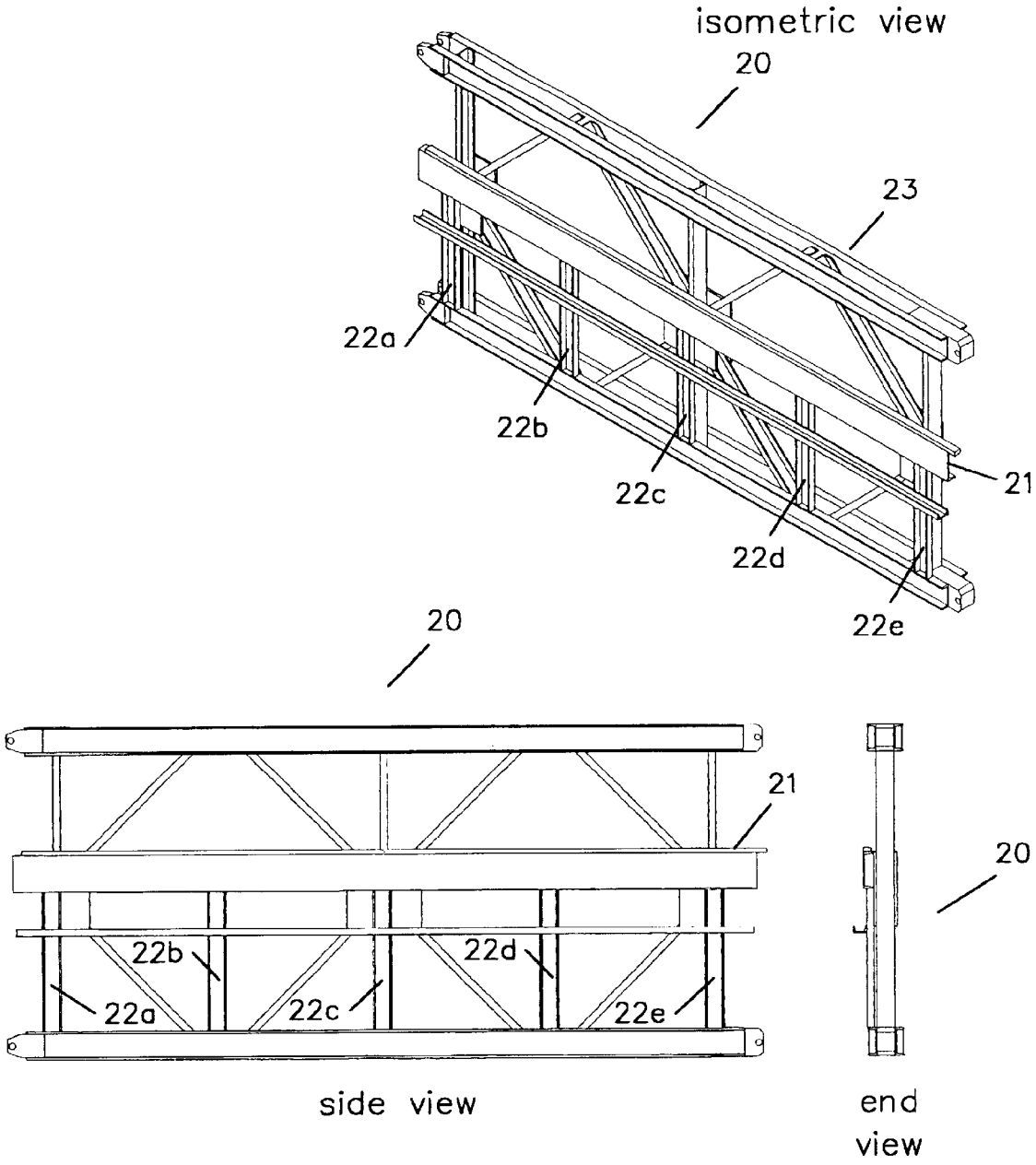
FIG. 2 shows side, end and isometric views of a truss panel assembly with a guide rail installed.

Trusses are commonly used to construct beams 11 and 12 because of their high strength to weight ratio. In the preferred embodiment modular truss components, such as those available from Bailey Bridges Inc. and Acrow Corporation of America, are used to assemble beams 11 and 12. By using such modular components beams of various lengths and weight limits can be assembled by anyone versed in the art. FIG. 2 shows side, end and isometric views of a single truss panel 23 that has been modified by the addition of a guide rail 21 and five guide rail supports 22*a*–22*e* to form a truss panel assembly 20. The guide rails are used to support the shuttle assembly (not shown) as will be further described below. Said rails may have rectangular or round cross-sections or be formed from channels or other sections that are sufficient to support the weight of the transport shuttle.

Figure 3:
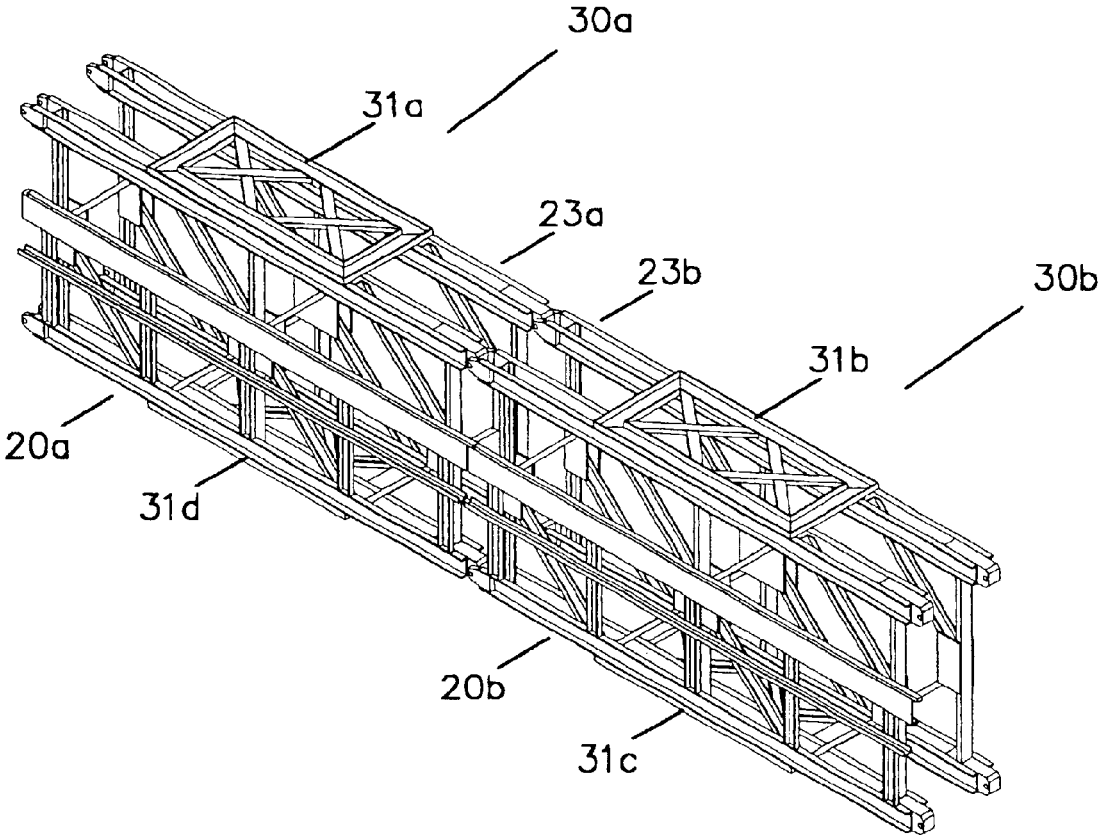
FIG. 3 is an isometric view of two beam sections attached end-to-end, demonstrating how the truss panel assemblies of FIG. 2 are combined with other standard truss panels and bracing frames to form the modular beam sections.

As shown in FIG. 3 truss panel assemblies 20*a* and 20*b* can be combined with truss panels 23*a* and 23*b* and bracing frames 31*a*–31*d* to form beam sections 30*a* and 30*b*. Additional beam sections can be added end-to-end to reach the desired span. Although not shown it is understood that the strength of the beam sections can be increased by adding additional truss panels and bracing frames alongside or below. This allows greater loads to be carried or longer spans to be used.

Figure 4:
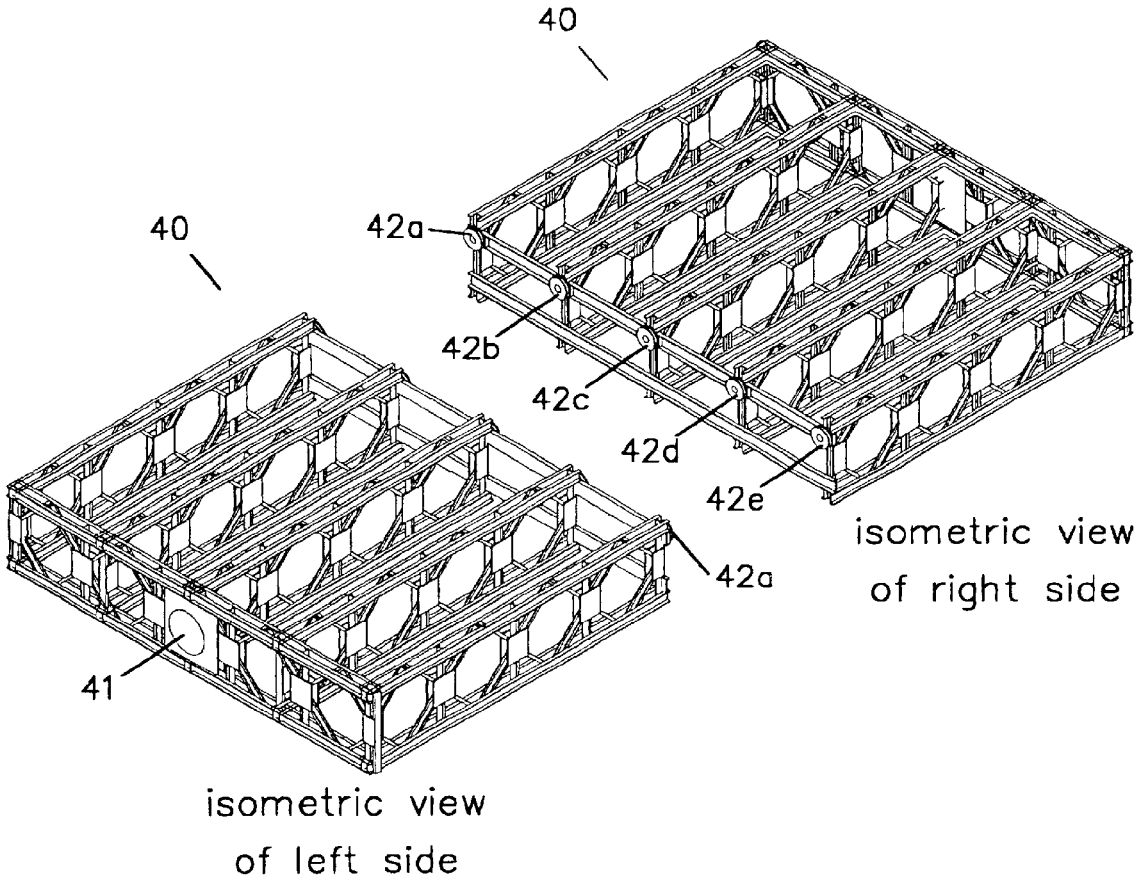
FIG. 4 is an isometric view of the transfer shuttle frame showing the rollers that support it on one side and the pivot that supports it on the other.

FIG. 4 shows isometric views of the shuttle frame 40 from the left and right-hand sides. Said shuttle assembly 40 may be built using standard truss panels (not indicated). Also shown are pivot 41 and rollers 42*a*–42*e* which support the shuttle frame 40 on the guide rails (not shown). This pivot 41 is a key element of the invention. Since the transfer station and the receiving station for the RORO system can move independently the sectional beam assemblies, 11 and 12 in FIG. 1, may have differing slopes. The side of the shuttle frame 40 that carries rollers 42*a*–42*e* is constrained by said rollers to follow the slope of one of the beam assemblies (not shown). The other side of said frame must then be free to rotate at pivot 41 so that the shuttle frame 40 can move freely regardless of the differing slopes of the beam assemblies. For simplicity pivot 41 is shown as the shaft of a journal bearing; roller bearings or other widely known bearings would more likely be used. Rollers 42*a*–42*e* are in wide use and are therefore not described in detail.

The pivot 41 must be vertically supported as it traverses one of the beam assemblies. This support is provided by the support assembly 50 as shown in FIG. 5. Pivot support frame 51 can be formed in many possible configurations exemplified by the truss shown herein. This frame 51 is carried by a series of rollers 56*a*–56*j* on the guide rail (not shown). Also attached to the frame 51 is the mating half 52 of the pivot 41 of FIG. 4.

FIG. 6 is an exploded view of the shuttle assembly 13, pivot support assembly 50 and several beam sections 30*a*–30*d*. One side of shuttle assembly 13 is supported by rollers 42*a*–42*e* (only one visible) on guide rails 21*a* and 21*b* which form part of beam sections 30*a* and 30*b*. The other side of shuttle assembly 13 is pivotably supported on support assembly 50 by pivot 41 and its mating half 52. Support assembly 50 is in turn supported by rollers 56*a*–56*j* on guide rails 21*c* and 21*d* (only one visible) which form part of beam sections 30*c* and 30*d*.

As described above shuttle 13 is enabled to freely traverse beam assemblies 11 and 12 in FIG. 1. A means to move said shuttle is next described.

FIG. 7 shows a chain 71, idler sprockets 72 and 73, drive sprocket 74 and drive shaft 75. Chain 71 spans the length of the RORO system and is fixed at both ends. It is suspended within a channel 76 or other means to prevent excessive sag. A motor 77 is mounted within the shuttle frame 40 (only partially visible). Said motor may be self contained (for example a diesel engine with a fuel supply mounted on the shuttle) or powered from either the transfer or receiving stations (e.g., an electric motor). Motor 77 drives shaft 75 and drive sprocket 74. Said sprocket engages chain 71 to impart motion to the transit shuttle. Other means of imparting motion, such as a capstan drive, cable or a rack and pinion gear, may be substituted for those described. The first of these cannot apply as much force as the system described above while the last is far more expensive. Tensioned cables driven by sheaves may prove to be satisfactory.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A machine comprising:

(a) at least two beams disposed between a first station and a second station, each of said at least two beams being fixed with respect to the first station such that there is no horizontal or vertical displacement or rotation about said beams' respective longitudinal axes;

(b) support means for each of said at least two beams at the second station, said support means allowing displacement along, and rotations normal to, said beams' respective longitudinal axes;

(c) connecting means between said at least two beams that provides constant spacing without substantially increasing torsional stiffness;

(d) a transfer shuttle that can traverse the length of said at least two beams thereby allowing roll-on/roll-off equipment transfer without the need for a continuous deck; and (e) means for imparting motion to said transfer shuttle.

2. The machine of claim 1 wherein said motion imparting means comprises a roller chain engaged by a sprocket wherein said sprocket is driven by a motor.

3. The machine of claim 1 wherein said transfer shuttle is supported on rollers.

4. The machine of claim 1 wherein the first station is a loading, station and the second station is an unloading station.

5. The machine of claim 1 wherein the first station is an unloading station and the second station is a loading station.

6. A machine comprising:

(a) at least two beams disposed between a first station and a second station, each of said at least two beams being fixed with respect to the first station such that there is no horizontal or vertical displacement or rotation about said beams' respective longitudinal axes;

(b) support means for each of said at least two beams at the second station, said support means allowing displacement along, and rotations normal to, said beams' respective longitudinal axes;

(c) connecting means between said at least two beams that provides constant spacing without substantially increasing torsional stiffness;

(d) a transfer shuttle that can traverse the length of said at least two beams thereby allowing roll-on/roll-off equipment transfer without the need for a continuous deck, wherein said transfer shuttle is (i) horizontally pivoted on one side, and (ii) supported on rollers; and (e) means for imparting motion to said transfer shuttle, wherein said motion imparting means comprises a roller chain engaged by a sprocket and wherein said sprocket is driven by a motor.

7. The machine of claim 6 wherein the first station is a loading station and the second station is an unloading station.

8. The machine of claim 6 wherein the first station is an unloading station and the second station is a loading station.

9. A roll-on/roll-off transfer system for ships comprising:

(a) at least two beams, disposed between a first station and a second station, without a continuous deck, wherein the at least two beams are (i) fixed at the first station such that there is no horizontal or vertical displacement or rotation about the beams' respective longitudinal axes at the first station, (ii) fixed at the second station such that there may be displacement along, and rotations normal to, said beams' respective longitudinal axes at the second station;

(b) at least two connecting members, said connecting members connecting the at least two beams;

(c) a transfer shuttle upon which equipment or at least one vehicle can be carried as said shuttle traverses the length of the at least two beams between the first station and the second station, wherein said transfer shuttle is (i) horizontally pivoted on one side, and (ii) supported on rollers running on the at least two beams; and (d) means for imparting motion to said transfer shuttle.

10. The roll-on/roll-off transfer system of claim 9 wherein said at least two beams are connected by members that provide constant spacing without substantially increasing torsional stiffness.

11. The connecting members of claim 10 wherein said members are attached to said at least two beams by pinned joints.

12. The roll-on/roll-off transfer system of claim 9 wherein said means for imparting motion comprises a roller chain engaged by a sprocket and wherein said sprocket is driven by a motor.

13. The roll-off transfer system of claim 12 wherein said motor is a self-contained reciprocating engine with an attached fuel tank.

14. The roll-on/roll-off transfer system of claim 9 wherein the first station is a loading station and the second station is an unloading station.

15. The roll-on/roll-off transfer system of claim 9 wherein the first station is an unloading station and the second station is a loading station.

16. A method of transferring equipment between a loading station and an unloading station comprising:

(a) moving a transfer shuttle to a point adjacent to the loading station, wherein:

(i) at least two beams are disposed between the loading station and the unloading station, and wherein each of said at least two beams is:

(a) fixed at the loading station such that there is no horizontal or vertical displacement or rotation about said beams' respective longitudinal axes at the loading station, and (b) fixed with respect to the unloading station such that there may be displacement along, and rotations normal to, said beams' respective longitudinal axes at the unloading station, (ii) support means for each of said at least two beams at the unloading station allow displacement along, and rotations normal to said beams' respective longitudinal axes, (iii) connecting means between said at least two beams provide constant spacing without substantially increasing torsional stiffness, and (iv) the transfer shuttle can traverse the length of said at least two beams thereby allowing roll-on/roll-off equipment transfer without the need for a continuous deck;

(b) transferring a load onto said transfer shuttle;

(c) moving said transfer shuttle to a point adjacent to the unloading station;

(d) transferring the load from said transfer shuttle to the unloading station; and (e) returning said transfer shuttle to the loading station.

17. The method of claim 16 wherein the transfer shuttle is (i) horizontally pivoted on one side, and (ii) supported on rollers.

18. The method of claim 16 wherein:

(a) means for imparting motion impart motion to the transfer shuttle;

(b) the means for imparting motion comprise a roller chain engaged by a sprocket; and (c) the sprocket is driven by a motor.

* * * * *